United States Patent [19]

Nystrom

[11] 4,019,953

[45] Apr. 26, 1977

[54] APPARATUS FOR REMOVING DUST FROM REGION ADJACENT DOCTOR BLADE

[75] Inventor: Karl Gustav Nystrom, Vaxjo, Sweden

[73] Assignee: Aktiebolaget Svenska Flaktfabriken, Nacka, Sweden

[22] Filed: Jan. 22, 1976

[21] Appl. No.: 651,587

[30] Foreign Application Priority Data

Jan. 31, 1975 Sweden ..... 7501053

[52] U.S. Cl. ..... 162/272; 15/256.51; 15/306 A; 34/85; 162/264

[51] Int. Cl.[2] ..... D21G 3/04

[58] Field of Search ..... 162/272, 264; 34/85; 15/301, 345, 347, 409, 306 A, 256.51

[56] References Cited

UNITED STATES PATENTS

| | | | |
|---|---|---|---|
| 1,794,058 | 2/1931 | Broughton | 15/301 X |
| 2,888,073 | 5/1959 | Corbin et al. | 162/272 X |
| 2,984,263 | 5/1961 | Loepsinger | 15/301 X |
| 3,003,176 | 10/1961 | Goyette | 15/345 X |
| 3,526,017 | 9/1970 | Kleimola | 162/272 X |
| 3,943,596 | 3/1976 | Wright et al. | 15/301 |

*Primary Examiner*—S. Leon Bashore
*Assistant Examiner*—Richard V. Fisher
*Attorney, Agent, or Firm*—Howson and Howson

[57] ABSTRACT

A bin-like arrangement with a mesh near its bottom collects dust from near the doctor blade of a Yankee cylinder in a paper making machine; a trough-like arrangement having a sloping bottom at the lower end of the bin receives the dust, and a plurality of horizontal air jets are provided at different heights at different points along the trough to entrain and remove the accumulated dust, preferably through a suction outlet. The system greatly reduces the dust released to the adjacent environment, without interfering with normal doctor blade operation, and without interfering with normal handling of the separated paper.

13 Claims, 4 Drawing Figures

APPARATUS FOR REMOVING DUST FROM REGION ADJACENT DOCTOR BLADE

The present invention relates to a method and apparatus for the removal of dust from a working area. The ornamental appearance of one embodiment of the invention may be similar to that shown in Design application Ser. No. 607,380, filed Aug. 18, 1975, now U.S. Pat. No. D241,156, by the inventor of this application.

The manufacture of paper, particularly of so-called tissue quality, gives rise to a difficult dust problem. This problem has always been present, but has grown worse in recent times as, due to raw material shortage and rise in prices of first-class raw material, producers were forced to use raw material of less quality, for example so-called de-inked return paper, mechanical wood pulp and unbleached fibers. Furthermore, in recent times producers have been constrained to close so-called back water systems and reuse so-called noil fibers, due to both economical reasons and fiber shortage as well as environmental demands. In addition thereto, the demands on environmental conditions are high today, and the permitted hygienic limit values are reduced more and more. Due to these circumstances, one can say that today and for the future there is a difficult dust problem in manufacture, which hitherto has not been solved in any way.

The biggest and dominating source of dust in paper making is usually the doctor of a so-called Yankee-cylinder of a paper machine. The Yankee-cylinder is a highly heated drying cylinder, taking up and drying a wet continuous paper, which in dried condition is removed by means of the so-called doctor.

Naturally attention has been paid to this dust problem before, and one has tried to remove the dust by suction via a suction gap near the doctor. This suction gap tends, however, to be stopped up very quickly and furthermore causes problems with so-called paper threading, i.e. when the front end of the continuous paper is manually drawn through the machine; in doing so, the paper web is often sucked into said suction gap, which makes such handling difficult or impossible. For several reasons it is practically impossible to provide on the doctor itself a device for removing dust, as thereby unbalance of the doctor can be caused and, due to that, wear and tear of the expensive cylinder. To suck away the dust by ordinary ventilation is ineffective due to the distances involved. Blowing away the dust will cause fluttering of the web and stretchings in the so-called crape, so that an unequal so-called tambour would be obtained, which would be difficult to sell due to problems with converting.

The reasons set forth above make it clear that conventional means and methods have been tried without success for solving this dust problem.

One object of the present invention is to find new ways for removing dust as efficiently as possible without at the same time creating negative secondary effects or making the manufacture more difficult. Another object of the invention is generally to improve techniques in this field.

These objects are achieved in accordance with the invention by the method and apparatus covered by the appended claims. Tests of such apparatus have given excellent results with respect to efficiency in dust removal, without substantial negative secondary effects.

Further characteristics and advantages of the present invention will appear from the following specification with reference to the attached drawings, in which.

Figure 1:
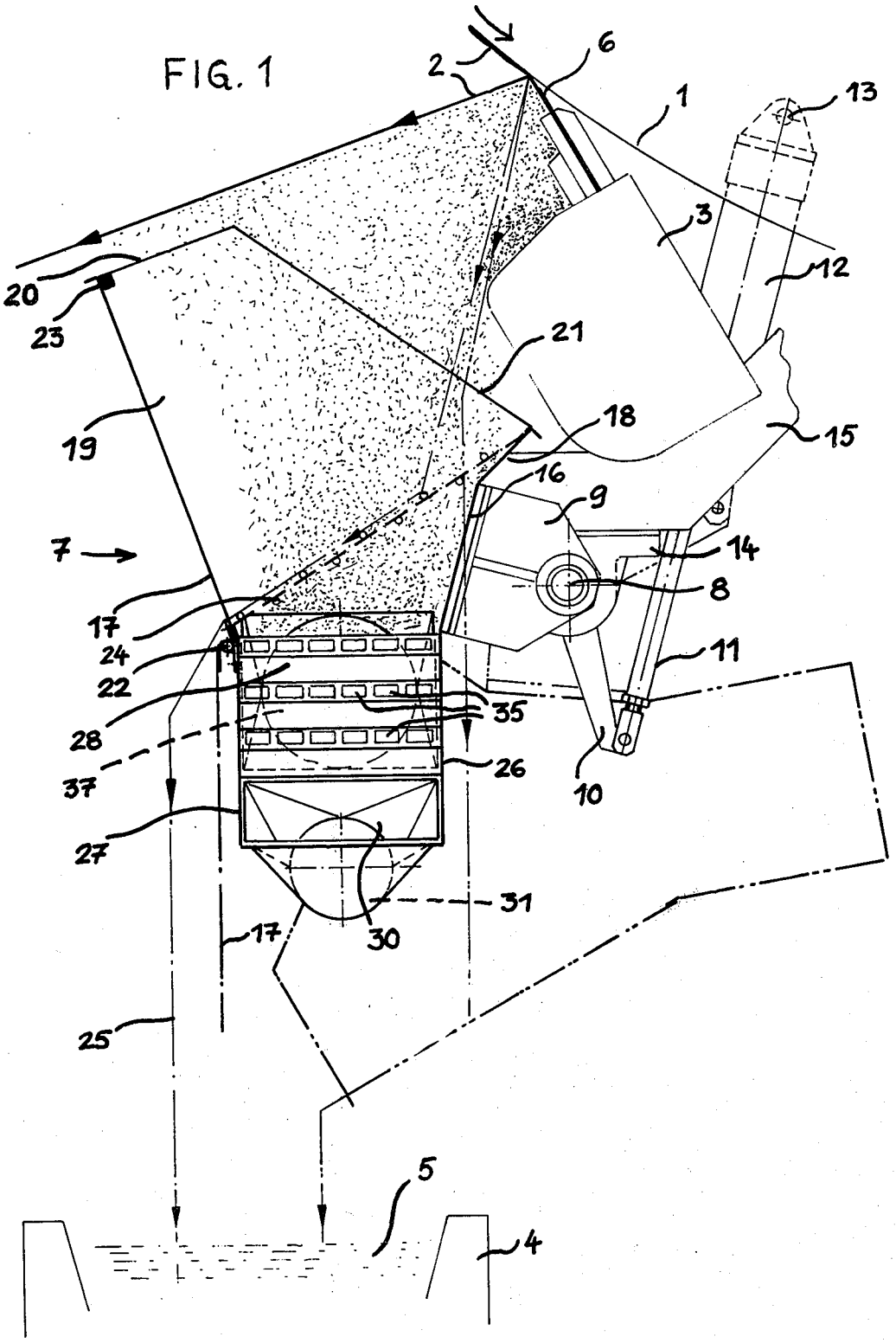
FIG. 1 shows a preferred embodiment of a device according to the present invention, partly schematized and seen from one side.

In the drawings, 1 designates a cylinder of a paper machine, preferably a so-called Yankee-cylinder. This cylinder is rotating in the direction indicated by an adjacent arrow. Only that peripheral part of the cylinder is shown, which is situated in the area of removal therefrom of a continuous paper web 2. The cylinder is abutted by the blade 6 of a so-called doctor 3, the edge of which blade abuts the cylinder tightly and extends along the whole cylinder in its axial direction. The doctor blade 6 abuts the cylinder 1 at a relatively small angle and removes the paper web 2 from the cylinder. In the area of removal, the web 2 is inclined according to this example at an angle of approximately 120°, and the web is later reeled up or subjected to further treatment.

As appears from FIG. 1, substantial quantities of dust are produced when removing the web from the cylinder in the area of the removed paper web and the doctor. The dust then tends to spread further and further.

According to the invention, at a radial distance from the cylinder 1 and from the area of paper removal, and disposed parallelly to the paper cylinder, a pick-up receptacle 7 is provided, which is swingably suspended from a shaft 8 below the doctor 3. More particularly, by means of shorter bearing arms 9 the pick-up receptacle is mounted on the shaft 8, which arms are connected to swinging arms 10, which in its turn are hingedly connected to the piston 11 of a hydraulic cylinder 12, which may extend approximately radially in the direction towards the center axis of the cylinder 1, and the other end 13 of which is swingably suspended. In FIG. 1 the continuous lines show the working position of the pick-up receptacle, and dash-dotted lines show a position for inspection or the like, when the pick-up receptacle should be out of the way, e.g. when changing the doctor blade or the like. In FIG. 1, 14 and 15 designate supports or the like for carrying the shaft 8 and the doctor 3 respectively.

According to a preferred embodiment shown in the drawings, the long sides 16, 17 of the pick-up receptacle 7 are diverging upwards. The long side 16 facing the doctor 3 may end in a strongly diverging part 18, which in the working position of the pick-up receptacle ends not far from the doctor 3. The long side 17 turned away from the doctor is preferably arranged at approximately right angles relative to the inclined paper web, and its free end terminates not far from this. In this way first of all, a suitable limitation of the zone of intensive dust production is created. The limitation is completed by fronts 19, the free ends 20 of which, near long side 17, may run parallel to, and end at a small distance from, the inclined paper web. The remaining free edges 21 of the fronts 19 may run approximately tangentially relative the cylinder, of course at a certain distance from the cylinder.

According to a preferred embodiment, the long side 17 is mounted swingably around its lower horizontal edge on a shaft 22; an advantageous locking of this long side in its upper position, i.e. the position for which it closes a side of receptacle 7, may be provided by magnetic locks 23, preferably in that area where the edge 20 meets fronts 19.

Between the region of shaft 22 and the free edge of long side 18 there extends an intermediate foraminous partition 24, preferably in the form of a coarse mesh net, a grid, or the like. This partition 24 is highly pervious to dust, and serves the purpose of catching and guiding the paper web 2 during so-called threading, i.e. when the front end of the paper web 2 manually is drawn through the machine. In so doing a lot of waste is caused, which in FIG. 1 is designated by 25, and which first of all is picked up by the partition 24, then slides down the same and falls when the long side is turned down, which in this case obtains when the position is as shown in dash-dotted lines, into a dissolving tank or the like 4 containing a bath 5. There the paper waste is dissolved or pretreated for further treatment, if it is desired to provide such a bath or the like.

Figures 2, 3, 4:
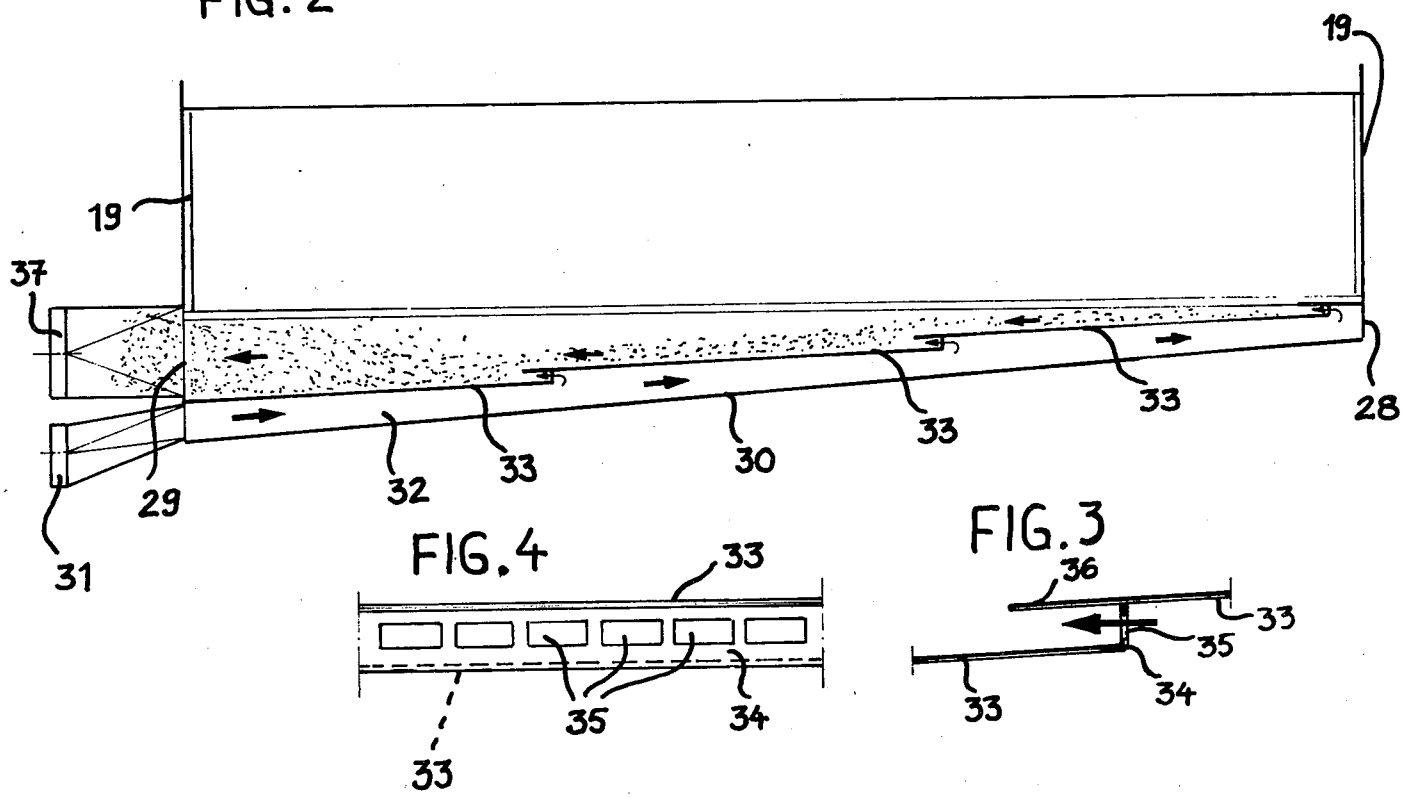
FIG. 2 shows a part of the device according to FIG. 1, as seen from the left in FIG. 1.
FIG. 3 shows a detail of FIG. 2 on an enlarged scale.
FIG. 4 is a view from the right in FIG. 3.

The long sides 16, 17 and the fronts 19 extend downwards to a more box-like dust removal part having long sides 26, 27 and fronts 28, 29. This part is closed at its lower side by a bottom 30, which for example is inclined from front 28 downwards at an angle of e.g. up to 5° or 10° to front 29. To the lower portion of front 29 is connected a duct 31 for the supply of compressed air. The pressure may be for example 6 kp or 100 mm. water column of manometer. Duct 31 is connected to a bottom channel 32 constituted by the pick-up receptacle 7, which channel preferably extends along the entire length of the receptacle, i.e. to the front 28. Upwardly this bottom channel 32 is limited by stair-like partitions 33, which in the side view or longitudinal section as shown in FIG. 2 are almost parallel to the bottom 30. The transitional zone between two adjacent partitions 33 is shown in FIG. 3. There one can see that the partition 33 which is situated next to duct 31 is inclined upwardly at approximately a right angle to constitute an end closure part 34. This part 34 contains openings 35, through which the supplied compressed air is reversed at an angle of approximately 180° to flow backward towards front 29. Partly for guaranteeing and stabilizing of this reversal and new direction of flow above the partitions, partition 33 which is connected towards front 28, is prolonged a bit beyond part 34 to form a projection 36.

As is apparent from FIG. 2, there is a plurality of such stair-like transitions between the various partitions. In this way there is obtained above these partitions one main stream directed towards front 29 and composed of minor streams of compressed air added to each other. These streams preferably have relatively high impulse, e.g. a speed of 35–50 m/sec in relation to channel 32 outside the openings 35. These impulse streams are directed towards front 29 in the area thereof immediately above duct or connection 31. There the impulse streams are collected by a suction opening 37 with preferably substantially larger width than connection 31. Suction opening 37 leads to a channel (not shown) for removing the impulse streams and the dust laden air ejected with them. Thanks to their high impulse, the air streams blowing out of channels 32 tend to take with them a part of the surrounding air above the partitions 33 in the pick-up receptacle. By either choosing suction opening 37 with relatively large diameter, width or height and/or by connecting to suction opening 37 a vacuum source, e.g. by means of a small pump, substantial quantities of air will be removed from the pick-up receptacle by means of said impulse jets and with these air quantities dust contained in them will be removed from the doctor zone. The volume-relationship between the impulse air blown out of opening 35 and the air ejected with it from the pick-up receptacle is preferably 1:2 to 1:4, i.e. the device is so dimensioned and shaped and the speed of the impulse air is so chosen, that this relationship is obtained. In the opening 37, air speed can be between 10 and 15 m/sec with 5–6 mm. water column of manometer.

Thanks to this structure of the device according to the invention, a removal of dust laden air is obtained, which removal is substantially uniform along the entire length and width of the bottom 30. In this way a uniform suction is obtained in the entire zone of dust production, and first of all one avoids relatively limited zones or areas with very high suction force and the disadvantages connected with this. To a certain extent the device according to the invention is using gravitation of dust particles, which is augmented thanks to the uniform suction of this device. By the provision of an air film or air cushion covering the entire bottom, it is practically impossible for larger dust accumulations to arise. In this way this device will also be self-cleaning and reliable in running. Thanks to the stair-like shape at the bottom, consecutive acceleration and retardation steps with an agglomeration effect on the dust particles are obtained, which in concentrated form are removed through the opening 37.

The embodiments described in the foregoing and shown in the drawings are to be regarded as non-limiting examples only, which may be modified and completed in any manner within the scope of the invention and following claims. Accordingly the device according to the invention is in no way usable only in connection with paper machines. This device can be used in most different fields involving dust production. The locking of long side 17, i.e. in this case the retaining power of the magnetic locks 23, is preferably arranged in a way that this long side is turned down automatically, i.e. the retaining power of the magnetic locks is overcome when a certain quantity of the threaded paper web has entered the upper part of the pick-up receptacle above the partition. Here it should also be emphasized that since the pick-up receptacle is suspended independently of the doctor, it can in no way influence the latter adversely.

While the invention has been described with particular reference to specific embodiments in the interest of definiteness, it will be understood that it may be embodied in a variety of forms diverse from those specifically shown and described, without departing from the spirit and scope of the invention as defined by the appended claims.

What is claimed:

1. In combination with doctor blade means operable to produce dust in a dust production region adjacent said doctor blade:

dust pick-up receptacle means forming an open-topped chamber adjacent said dust-production region for receiving said dust, said receptacle means having opposite lateral wall portions which diverge from each other in the direction toward said dust-production region and shield members associated therewith for at least partially confining said dust to the vicinity of said region of its production;

said receptacle means also having an air-stream inlet and an air-stream outlet in the walls thereof, said outlet being of larger cross-sectional area than said inlet;

the lower portion of said receptacle means being in the form of a box-like elongated trough the bottom of which is sloped from one end to the other end at a substantial angle to the horizontal;

foraminous partition means extending across the interior of said receptacle means at a position spaced above the bottom thereof, said partition means being pervious to said dust;

means mounting said receptacle means pivotably and independently of said doctor blade means to permit swinging said receptacle means into and out of adjacency to said dust production region;

said mounting means comprising shaft means, support means pivotably mounting said receptacle means on said shaft means, fluid-pressure operable cylinder means including piston means reciprocable therein, and swinging arms connecting said piston means to said support means for pivoting said receptacle means in response to reciprocation of said piston means; and means responsive to air supplied from said inlet for forming a plurality of higher speed jets directed toward said outlet to entrain and remove dust-laden air in said receptacle by way of said outlet.

2. The apparatus of claim 1, in which said inlet and said outlet are adjacent each other on the same side of said receptacle means.

3. The apparatus of claim 1, wherein said outlet and said inlet are positioned in a wall at said other end of said receptacle means toward which said bottom interior slopes, with said inlet lower than said outlet.

4. The apparatus of claim 1, comprising suction means connected to said outlet.

5. The apparatus of claim 1, in which said means responsive to air supplied from said inlet for forming a plurality of higher speed jets comprises partition means for forming a bottom channel in said receptacle means and having a plurality of discharge openings, said inlet communicating with said bottom channel whereby air under pressure supplied to said inlet is formed into said jets at said openings.

6. The apparatus of claim 5, in which said partition means extends along said channel in steps downward in the direction toward said inlet, and said openings are in the upwardly extending sides of said steps.

7. The apparatus of claim 6, comprising projections extending toward said outlet from the tops of at least some of said upwardly-extending sides.

8. The apparatus of claim 6, in which said discharge openings are transversely spaced apart along a horizontal direction in each of said sides.

9. Apparatus in accordance with claim 1, including means maintaining the air pressure in said inlet and at the bottom of said receptacle means at about 6 kp and 100 mm. of water column, respectively.

10. Apparatus according to claim 1, including means maintaining the ratio at said outlet between the total flow of air from said jets and the flow of outer air from said receptacle means at between about one-half to one-fourth.

11. Apparatus according to claim 1, wherein said receptacle means comprises a normally-upright side wall pivotably mounted at its lower end to be pivoted downwardly from its normal upright position.

12. Apparatus according to claim 11, comprising magnetic locking means for retaining said side wall on its normal upright position.

13. Apparatus according to claim 11, comprising locking means holding said side wall in its normal upright position when the pivoting load thereon is relatively light, but responsive to pivoting loads of more than a predetermined maximum to release and permit said side to swing downwardly.

* * * * *